United States Patent [19]

Muller

[11] Patent Number: 4,993,094

[45] Date of Patent: Feb. 19, 1991

[54] BRIDGE COMPRISING A BRIDGE FLOOR AND ELEMENTS SUPPORTING SAID FLOOR, PARTICULARLY A LONG SPAN CABLE-STAYED BRIDGE, AND PROCESS OF CONSTRUCTION

[75] Inventor: Jean Muller, Suresnes, France

[73] Assignee: Scetauroute, Paris, France

[21] Appl. No.: 297,865

[22] PCT Filed: Mar. 25, 1988

[86] PCT No.: PCT/FR88/00157

§ 371 Date: Nov. 28, 1988

§ 102(e) Date: Nov. 28, 1988

[87] PCT Pub. No.: WO88/07604

PCT Pub. Date: Oct. 6, 1988

[30] Foreign Application Priority Data

Mar. 27, 1987 [FR] France ..... 87 04338

[51] Int. Cl.[5] ..... E01D 11/00; E01D 9/06; E01D 7/02; E01D 21/04

[52] U.S. Cl. ..... 14/1; 14/73; 14/18; 14/6

[58] Field of Search ..... 14/3, 4, 6, 8, 9, 11, 14/13, 14, 17–23, 73, 1; 52/223 R, 223 L, 225, 637, 638, 648, 655, 692, 693, 745

[56] References Cited

U.S. PATENT DOCUMENTS

| | | | |
|---|---|---|---|
| 3,712,010 | 1/1973 | Porter et al. | 52/223 R |
| 3,975,476 | 8/1976 | Finsterwalder | 14/23 X |
| 4,161,088 | 7/1979 | Gugliotta et al. | 52/223 R |
| 4,282,619 | 8/1981 | Rooney | 14/6 |
| 4,489,659 | 12/1984 | Kamohara et al. | 14/3 X |
| 4,513,465 | 4/1985 | Schambeck | 14/17 |
| 4,543,008 | 9/1985 | Salama et al. | 52/693 X |
| 4,746,056 | 5/1988 | Thomsen | 52/637 X |

FOREIGN PATENT DOCUMENTS

| | | |
|---|---|---|
| 53965 | 6/1982 | European Pat. Off. . |
| 144271 | 3/1985 | European Pat. Off. . |
| 188395 | 7/1986 | European Pat. Off. . |
| 1152436 | 8/1963 | Fed. Rep. of Germany . |
| 1237124 | 6/1960 | France . |
| 2526062 | 11/1983 | France . |
| 2564871 | 11/1985 | France . |
| 2104134 | 3/1983 | United Kingdom . |

*Primary Examiner*—Ramon S. Britts
*Assistant Examiner*—Matthew Smith
*Attorney, Agent, or Firm*—Breiner & Breiner

[57] ABSTRACT

Bridge comprising a bridge floor, said floor consisting of an upper boom (4) which may form a road section, a lower boom (5) which may be formed by a tubular succession of sections, and diagonal linking girders (6), joining the booms, their axes converging on that of the lower boom. Those elements subjected to high stress are preferably to be provided with individual pretensioning elements. The gussets (15) linking the diagonals with the upper boom carry advantageously the attachment elements of the supporting stay cables (2).

21 Claims, 9 Drawing Sheets

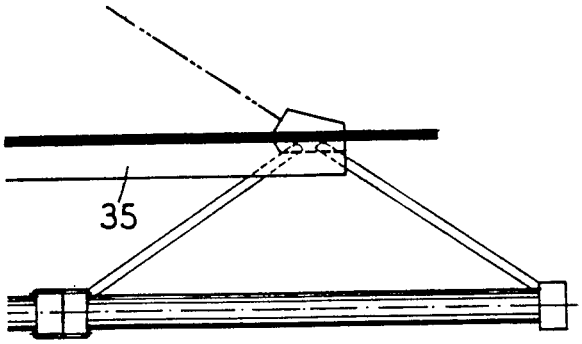
FIG.:24
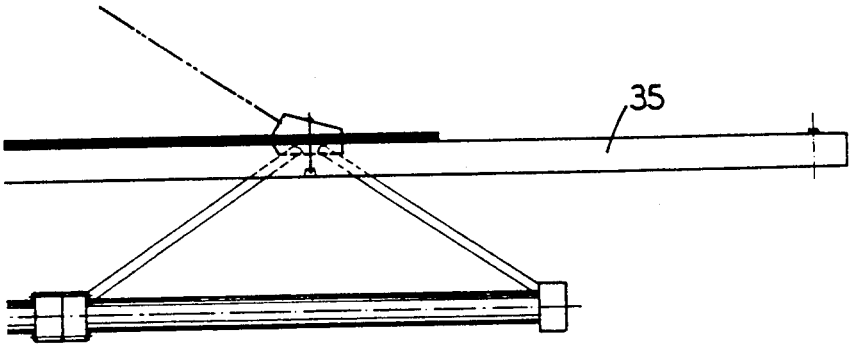
FIG..25
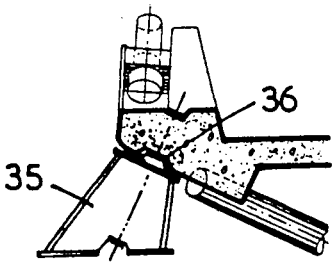
FIG.:26
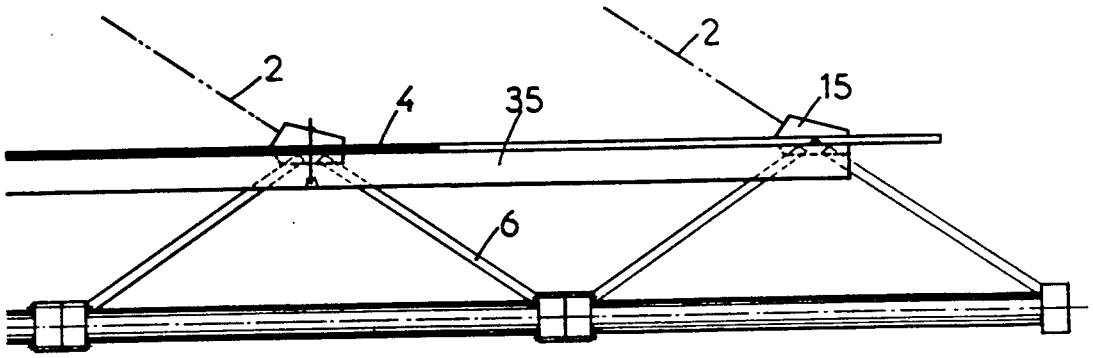
FIG.: 27

BRIDGE COMPRISING A BRIDGE FLOOR AND ELEMENTS SUPPORTING SAID FLOOR, PARTICULARLY A LONG SPAN CABLE-STAYED BRIDGE, AND PROCESS OF CONSTRUCTION

FIELD OF THE INVENTION

The present invention relates to a new bridge structure composed of a deck and of means for supporting this deck, and particularly to a new wide-span guyed bridge structure and to a process for constructing such a bridge.

PRIOR ART

In the present state of the art, either suspension bridges or guyed bridges are used for crossing wide spans. Suspension bridges are justified in economic terms for exceptional spans, but their flexibility presents problems for traffic, especially railroad traffic, and for aeroelastic stability. Where guyed bridges are concerned, these do not have the sensitivity to wind of suspension bridges, particularly if the deck is constructed from concrete which is a material giving the structure a sufficient weight and a high rigidity. However, the weight limits the spans, so that, beyond the scope of use of concrete guyed bridges, decks of a composite steel/concrete structure or decks made completely of metal have been employed.

In the present state of the art, guyed decks of composite steel/concrete structure have always been composed of an upper chord made of concrete and forming a roadway slab, carried by transverse and longitudinal stiffening girders intended for transferring the loads to the guys, whilst ensuring that the deck has sufficient rigidity. Embodiments of this type are recent and highlight the current limitations of the known means as regards the following points:

- the cohabitation of the metal framework and the concrete in terms of the effects of shrinkage and the slow deformations of the concrete,
- the occurrence of temperature gradients caused as a result of the exposure to the sun of metal surfaces having low thermal inertia,
- the risk of general buckling of the structure as a result of the instability of the lower chord of the longitudinal stiffening girders when the stresses attributable to the loads, added to the effects mentioned above, approach the compression yield limit of the metal,
- the very low resistance of this type of structure towards accidental forces, such as the impact of a motor truck against a guy.

Several of these disadvantages can be overcome by increasing the height and size of the longitudinal stiffening girders, but this is at the expense of the wind and economy.

Lattice structures can also be used because they make it possible to obtain a high rigidity in terms of bending and torsion, whilst at the same time ensuring maximum wind transparency. In the present state of the art, such lattice structures usually combine steel and concrete, but despite considerable research in this sector, no truly satisfactory solution has been found for transferring the forces between the chords and the diagonal struts to the various nodes of the lattice. The long-term behavior of such solutions is not known and the cost prices remain high.

SUMMARY OF THE INVENTION

The object of the invention is to overcome all the disadvantages mentioned above by providing a new structure which is both light, rigid and easy to produce and therefore economical.

To achieve this result, the invention provides a bridge composed of a deck and of means for supporting this deck, the deck comprising:

- an upper chord forming a roadway slab,
- a lower chord forming a continuous longitudinal element,
- connecting girders, called "diagonals", connecting the upper and lower chords and directed obliquely both relative to the vertical and relative to the length of the bridge and forming with the chords a three-dimensional lattice, the particular feature of this bridge being that the axes of the diagonals converge on the longitudinal axis of the lower chord or the mid-plane of the upper chord.

By "three-dimensional lattice" is meant a structure composed of elements which are similar to plane parts or rectilinear segments and which are connected to one another, this structure not being contained in one plane. The junction points of plane parts and/or of rectilinear segments will be called "nodes" hereafter.

Preferably, the parts of the chords which are subjected to high tensile forces and the diagonals which are subjected to high tensile forces are prestressed by means which are particular to each of the said chords and to each diagonal or to two concurrent diagonals.

According to preferred procedures:

- the means for prestressing the diagonals comprise prestressing reinforcements anchored at their two ends to the junction points of these diagonals with the upper chord and forming a V, the center of which is at the junction point of the said diagonals with the lower chord,
- the lower chord is formed from successive assembled portions and is equipped with longitudinal prestressing reinforcements which each put several assembled portions under compression,
- the means for prestressing the upper chord are composed of prestressing reinforcements connecting to one another, the nodes of the three-dimensional lattice which are formed by the junction points of the diagonals with the said upper chord.

The combination of these last three procedures results in an especially useful structure, because all the parts of the deck structure which experience high tension form a network of prestressed elements.

The deck which has just been described can be incorporated in bridges of various designs.

For wide-span or medium-span constructions, a guyed bridge is preferred, and in this case the means for supporting the deck are composed of guys connecting supporting masts to nodes of the three-dimensional lattice which are formed by the junction points of the diagonals with the upper chord. On this assumption, for medium spans it is possible for the bridge to have at least two continuous lower chords and an equal number of three-dimensional lattices comprising diagonals, the axes of which converge on the axis of a lower chord, the said chords being connected to one another by means of a crossbracing, these three-dimensional lattices each including part of the upper chord, and advantageously this bridge can comprise two lower chords and two three-dimensional lattices, and wherein the means for supporting the deck can be composed of guys connecting the nodes of the three-dimensional lattices arranged in the axial plane of the bridge to supporting masts.

According to an alternative version, likewise of the medium-span type, the means for supporting the deck are composed of guys connecting supporting masts to nodes of the three-dimensional lattice which are formed by the junction points of the diagonals with the lower chord.

The invention can also be used for bridges of much smaller spans and which are non-guyed. In such bridges where the deck is constructed in the way according to the invention mentioned above, the means for supporting the deck are composed of transverse bearings on which the upper chord rests, and there are additional prestressing reinforcements which follow a polygonal path connecting two successive transverse bearings, passing via deflection points located on the lower chord, and advantageously the additional prestressing reinforcements are not in the axial plane of the bridge.

The means for joining the diagonals to the chords are an element which is very important for putting the invention into practice. According to a preferred procedure, to make the junction between the diagonals and the lower chord, there are gussets made of bent sheet metal, comprising two wings which are each in a longitudinal plane containing the axis of diagonals fastened on it, the gusset being fastened to the lower chord in such a way that the bending axis of the wings of the gusset coincides with the longitudinal axis of the lower chord. Advantageously, also, the lower chord is formed from successive assembled portions, and at least some of the gussets are fastened to the points of assembly of successive portions.

According to another preferred procedure which is advantageously combined with the preceding one, to make the junction between the diagonals and the upper chord, there are gussets comprising a lower wing, arranged in a longitudinal plane containing the axis of the diagonals which are fastened on it, and an upper wing which is fastened to the upper chord, in such a way that the bending axis of the wings of the gusset is in the mid-plane of the upper chord.

In this case, according to expedient embodiments:

- the gusset has anchoring points for prestressing reinforcements of the diagonals and anchoring points for prestressing reinforcements of the upper chord,
- the connection between the gusset and the upper chord is a concrete/steel connection,
- the mid-plane of the upper wing of the gusset is in a longitudinal plane containing the axis of guys supporting the bridge, these guys being fastened to the said gusset. It is also possible for the upper wing to be doubled into two parallel wings, between which the guy is fastened, the bending axis in this case being formed by the intersection of the mid-planes of the upper and lower wings.

To obtain greater lightness, in bridges of very wide span, it is possible, furthermore, for the upper chord to form a concrete slab reinforced by continuous metal sections and prestressing reinforcements arranged perpendicularly relative to these metal sections.

According to the invention, the upper chord of the construction forming a roadway slab or carrying railroad traffic is produced from reinforced or prestressed concrete; the lower chord can either comprise reinforced or prestressed concrete or a composite steel/-concrete structure or be made completely of metal. It is possible advantageously to use a metal tube filled with concrete, the characteristics of which are described later. In the simplest form of the invention, the lower and upper chords are connected to one another by means of a series of diagonals arranged in two oblique planes forming an isosceles triangle in cross-section.

Where a guyed bridge is concerned, the two edges of the upper slab, at regular intervals, have the anchorages of the suspension guys, at the point of convergence of the abovementioned diagonals.

The advantages of this arrangement are that the torsional and bending rigidity of the bridge section are allied to a minimum weight and minimum wind purchase, thereby allowing considerable savings in comparison with the production processes known at the present time.

The invention also provides an original construction process designed for the bridge structure which has just been described.

This process involves the following steps:

- placing, on a deck part already mounted, two longitudinal temporary edging girders on either side of the upper chord, so as to be overhung by a length at least equal to the longitudinal dimension of a mesh of the three-dimensional lattice, each girder being retained by means of two successive nodes of the three-dimensional lattice already mounted,
- bringing up a new mesh of the three-dimensional lattice, this mesh comprising at least one node located on the lower chord, two nodes located on the upper chord and the diagonals corresponding to these nodes,
- fixing together this new mesh and the deck part already mounted, the new mesh being supported by means of the temporary edging girders,
- starting the operations again by advancing the temporary edging girders along the mesh which has just been fixed.

Where a guyed bridge is concerned, during the fixing of the new mesh to the deck part already mounted, a suspension guy is also preferably fastened to the said new mesh.

Advantageously, whether the bridge is guyed or not, temporary edging girders are used, these being equipped with means, such as studs, for immobilizing them in the correct position relative to the meshes of the three-dimensional lattice already mounted.

BRIEF DESCRIPTION OF THE DRAWINGS

The invention will now be described in more detail by means of practical non-limiting examples illustrated with the aid of the drawings in which:

FIGS. 24 to 27 show the successive phases in the construction of the deck according to the invention and the special means necessary for this construction.

DESCRIPTION OF THE EXEMPLARY EMBODIMENTS

Figure 1:
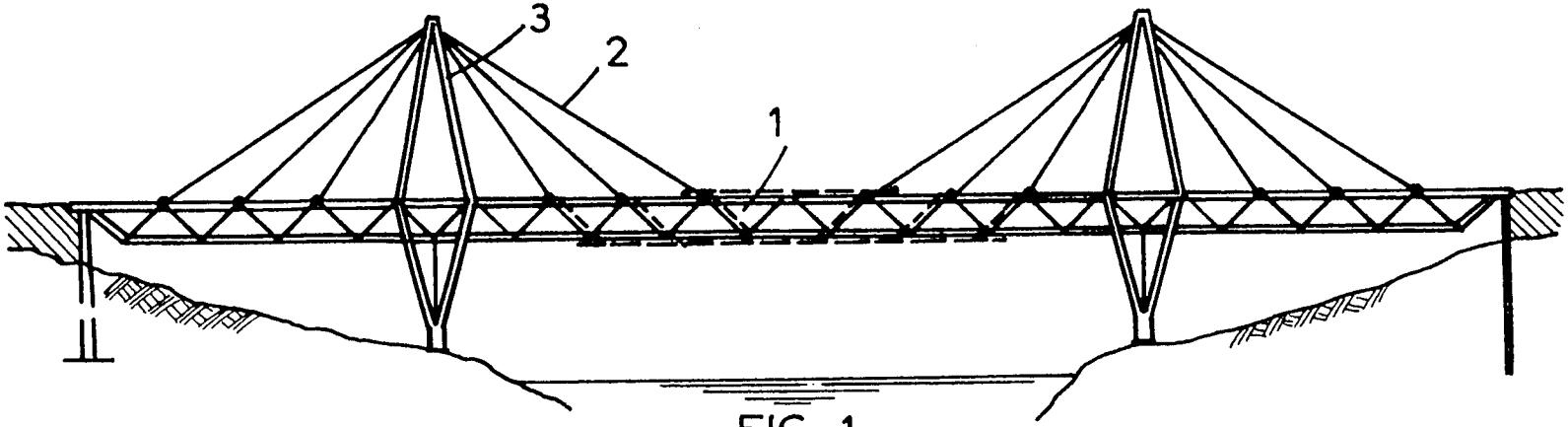
FIG. 1 is a longitudinal elevation view of a guyed bridge according to the invention.
Figure 2:
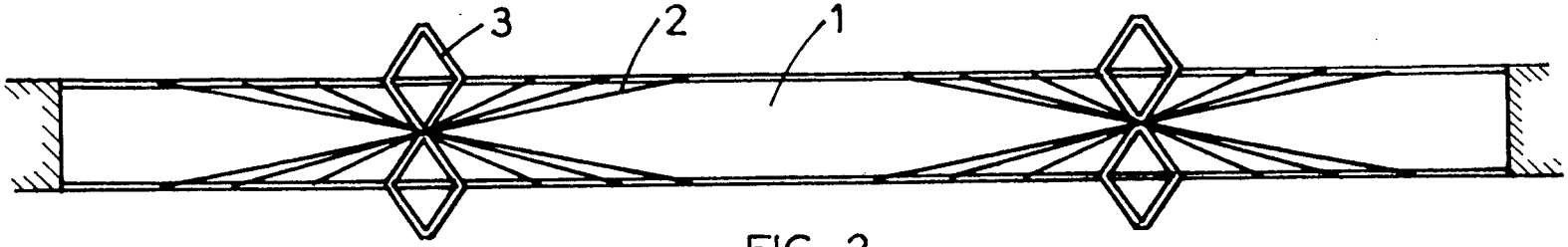
FIG. 2 is the plan view of the same construction.

In the embodiment of FIGS. 1 and 2, the bridge according to the invention comprises a deck 1 composed of a series of triangulated spacial elements suspended on guys 2 at points located at a uniform distance from one another. These guys are fastened towards the top of the supporting masts 3. For the sake of clarity, the central span is shown with only eight elements suspended by means of three guys on either side of the center support. In wide-span bridges, the spacing of the guys is variable between 10 and 20 m and the number of guys in the central half-span can reach 20 to 25.

Figure 3:
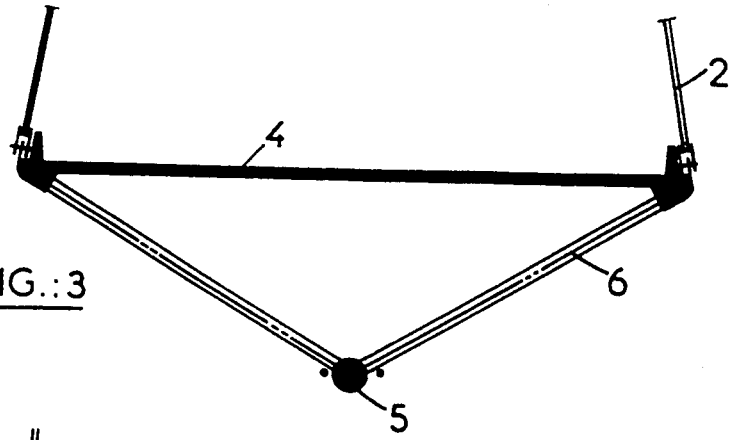
FIG. 3 is a running cross-section through a guyed deck, showing the concrete upper chord forming a roadway slab, the diagonals in the oblique planes and the tubular lower chord.
Figure 4:
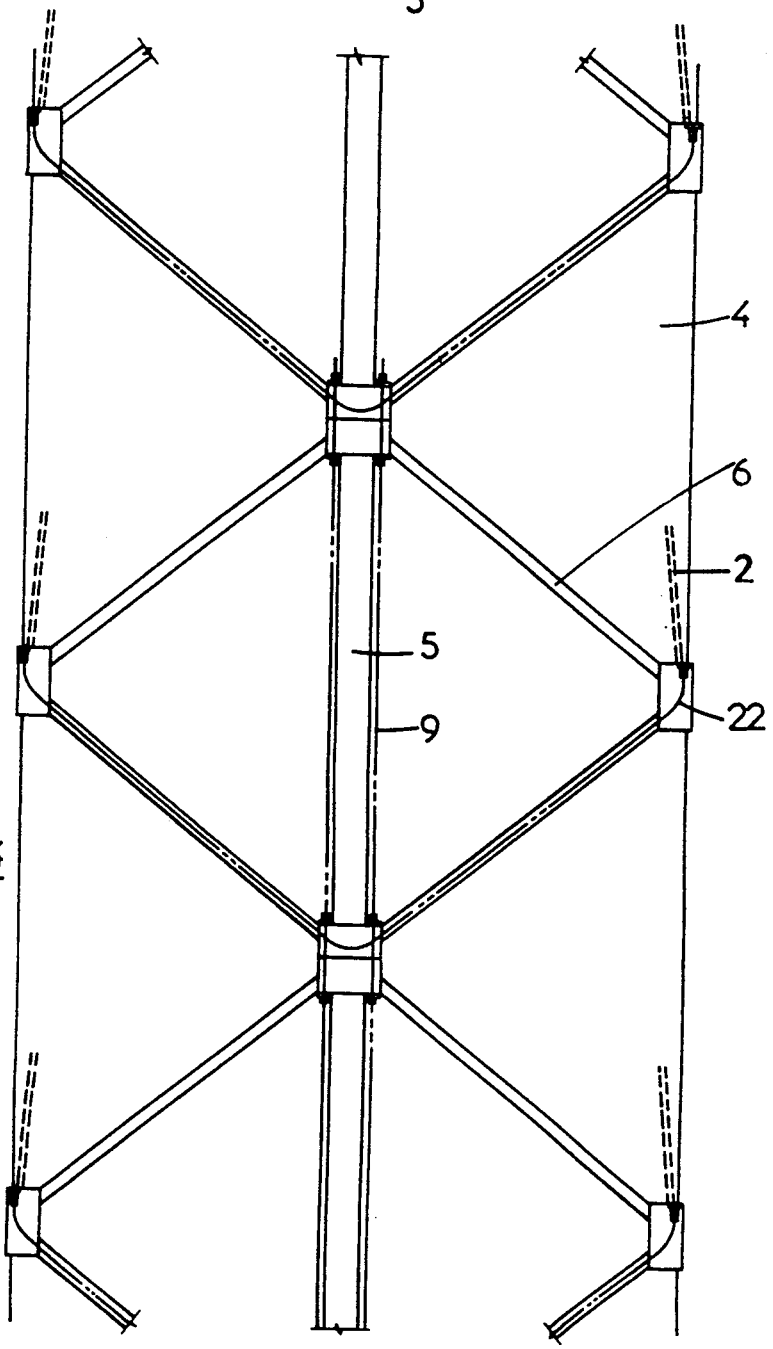
FIG. 4 is a plan view of the framework of the deck.
Figure 5A:
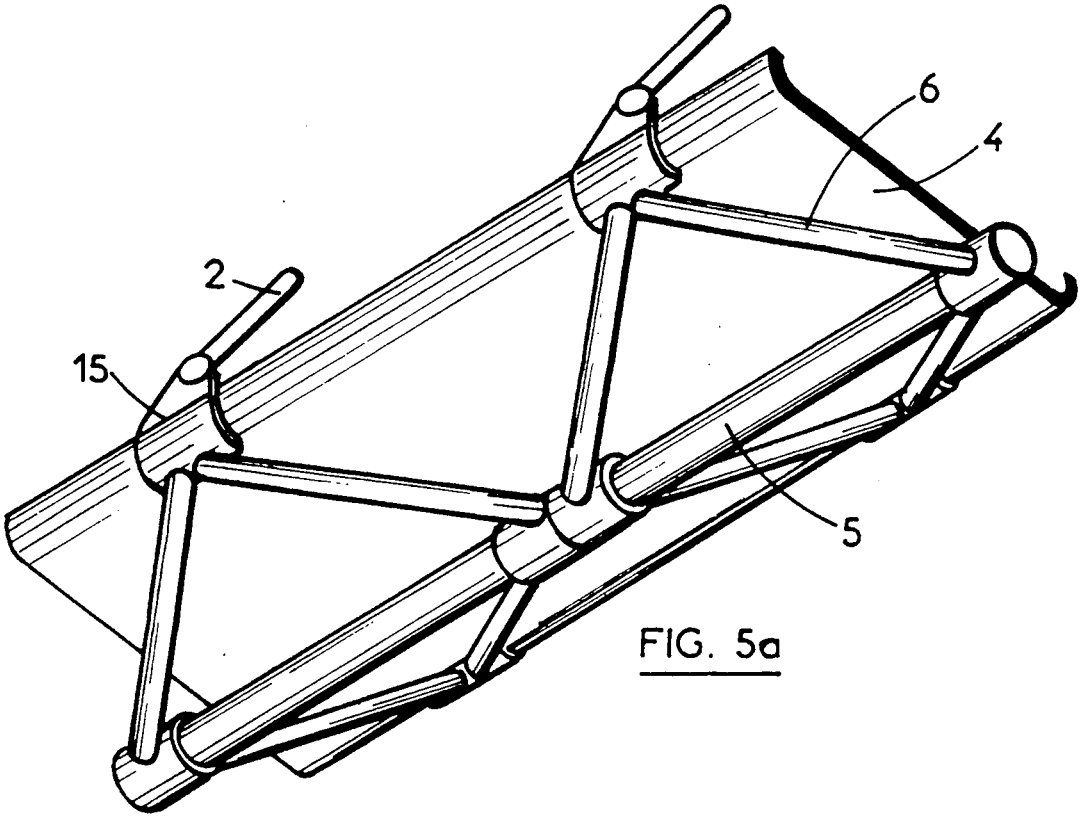
FIGS. 5*a* and 5*b* are partial axonometric views of the deck, showing the same component elements as in FIG. 4 for a guyed or non-guyed bridge.
Figure 5B:
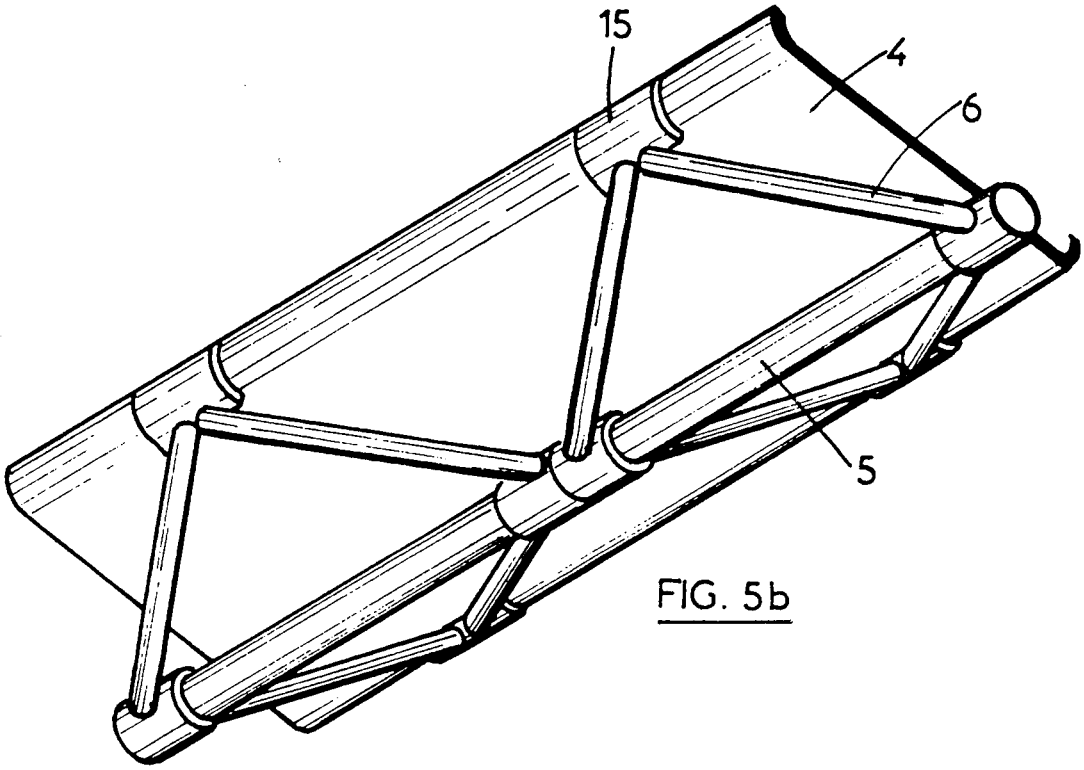
Figure 9:
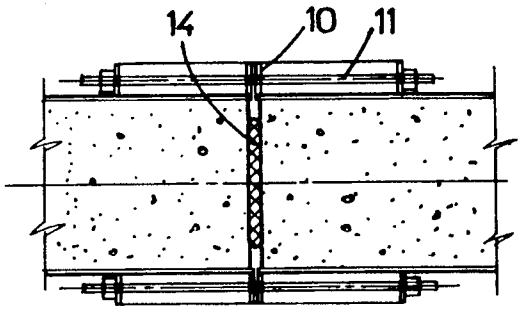
FIGS. 6 to 9 inclusive show a detail of an elementary portion of the lower chord, its composition, the node for junction with the diagonals and for assembly with the adjacent portions, and finally a detail of the joint between two portions.
Figure 8:
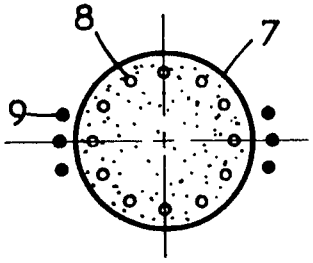
Figure 7:
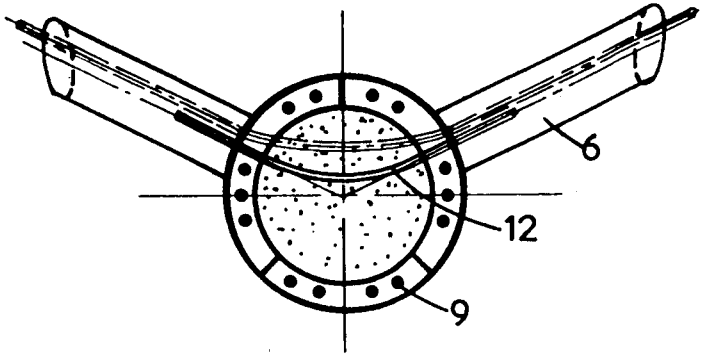

In its simplest form, the cross-section of the deck 1, shown in FIG. 3, is an isosceles triangle composed of an upper slab (or chord) 4, a lower chord 5 and diagonals 6, without intermediate bearings of the upper slab 4 between the two ends of the bridge. The plan view of FIG. 4 also shows that the planes of the diagonals are cut in triangles which are all identical and the vertices of which are located alternately on the edges of the upper slab 4 and on the lower central chord 5.

Figure 6:
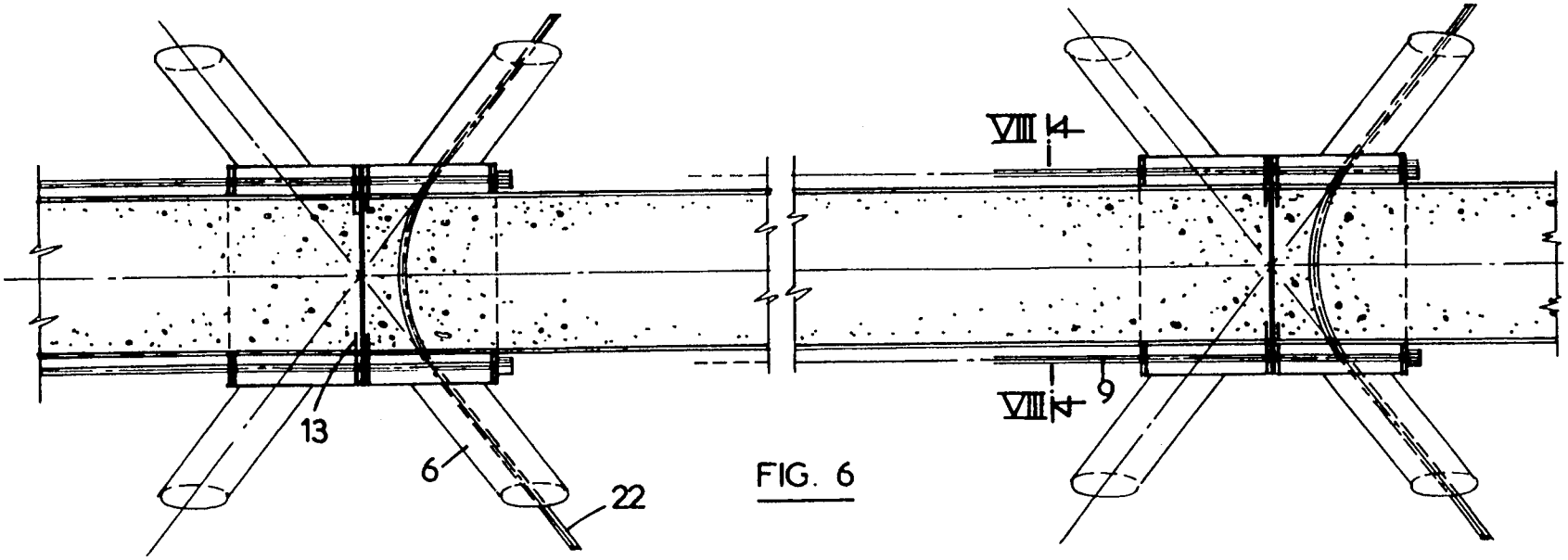

The lower chord 5, a detail of which is given in FIG. 6, is broken down, for the building of the construction, into portions of equal length separated by joints allowing rapid assembly during construction.

In the example described, the lower chord 5 is a metal tube 7 filled with concrete or not, depending on its location over the length of the bridge and the type of stresses to which it is subjected. According to the requirements of the project, and especially the intensity and direction of the forces exerted on this chord in the construction, it may be necessary and advantageous to provide separately or simultaneously the following ordinary reinforcements or prestressing reinforcements:

passive reinforcements embedded in the concrete in the zones where the compressive force is high, in order to reduce the stress in the materials, pretensioned prestressing reinforcements put under tension before the pouring of the concrete and anchored on the end flanges of each tube portion, and intended to put the metal tube under permanent longitudinal compression, post-tensioned prestressing reinforcements placed in a sheath 8 inside the filling concrete and intended to put the assembly composed of the metal tube and of the filling concrete under permanent longitudinal compression, post-tensioned prestressing reinforcements 9 placed outside the tube and tensioned in the construction over several portions after these have been assembled.

Successive portions of the lower chord are assembled by means of flanges 10 located opposite one another and connected longitudinally by means of high-strength bolts 11. The end flanges of each portion also possess a gusset 12 bent in the plane of the oblique diagonals, allowing the latter to be assembled by welding with the lower main chord. The flanges finally possess, as required, the anchorages for the outer prestressing of the lower chord. The bending axis of the gusset 12 coincides with the axis of the tube 7.

At least some of the portions of the tube are filled with concrete. The concrete for filling the tube, if there is any, can be used before or after the assembly of the chord in the construction. In both cases, it is advantageous to put the filling concrete under compression inside its metal casing in order to combat the subsequent effects of shrinkage and improve the relative adhesion of the two materials. Contrary to constructions using a composite metal-tube/filling-concrete chord where the variations in force and consequently the adhesion stresses occur continuously along the chord, in the construction which is the subject of the invention such force variations occur only in line with the junction nodes with the diagonals, in a zone where the arrangements used make any relative sliding of the concrete and the tube impossible. For this purpose, stiffeners or connectors 13 are provided in the vicinity of the flange.

From the point of view of construction, the tube is filled with concrete and put under compression easily with the aid of one or two temporary seals placed at the ends of the tube and fastened to the end flanges by means of a series of temporary bolts.

When the concrete is used before the chord is assembled in the construction, there is an injection device in the joint between two successive portions, to ensure perfect transmission of the longitudinal forces in the filling concrete.

Figure 11:
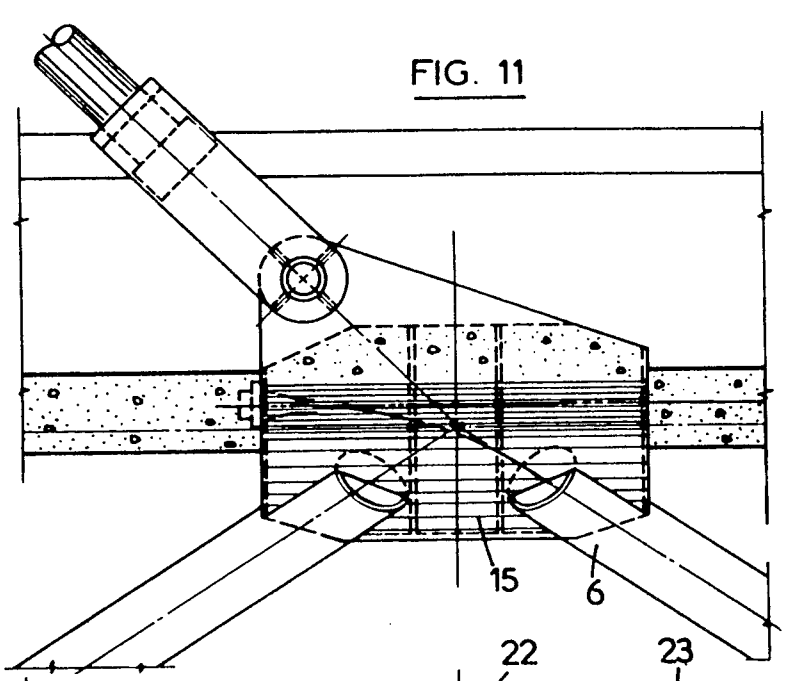
FIGS. 10 to 13 show a detail of the upper assembly node in three views (cross-section, longitudinal elevation and plan view) and an alternative embodiment of the fastening of the guys.
Figure 12:
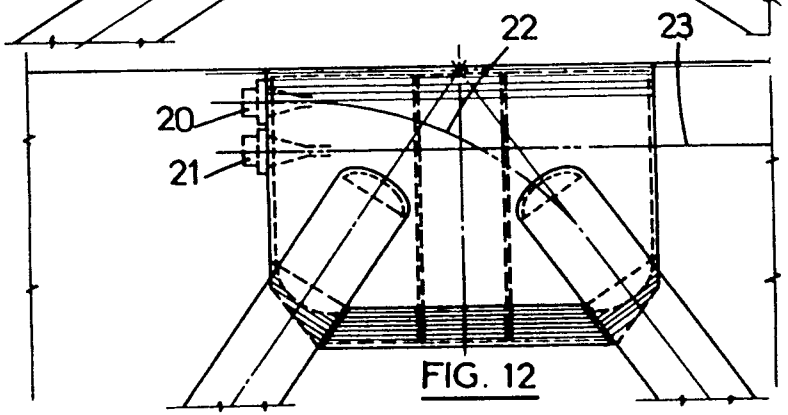
Figure 10:
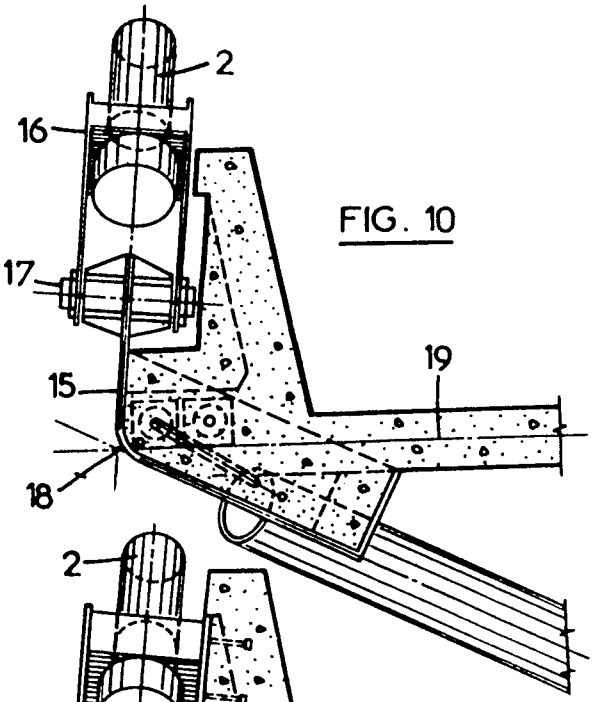
Figure 13:
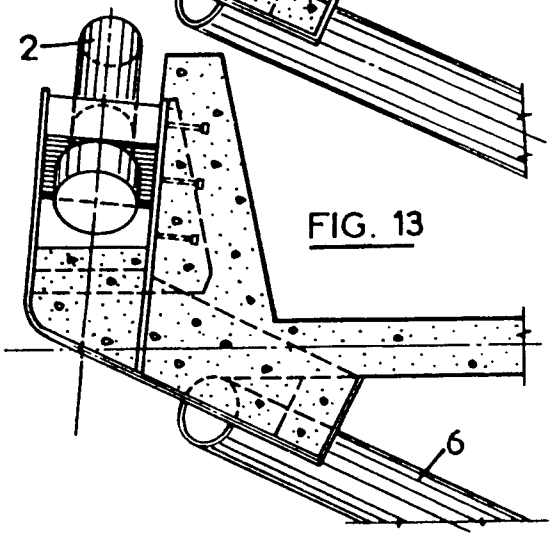
Figure 14:
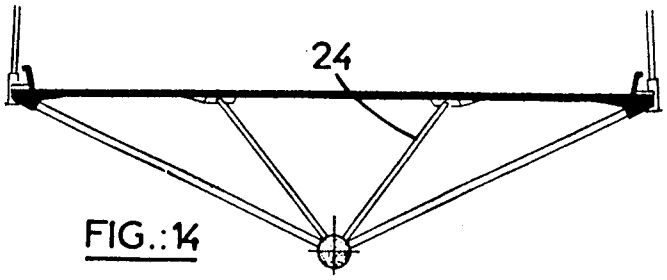
FIGS. 14 to 17 show the complementary structural elements necessary for putting the invention into practice, according to the intensity of the loads supported by the deck and the geometrical dimensions of the latter.
Figure 15:
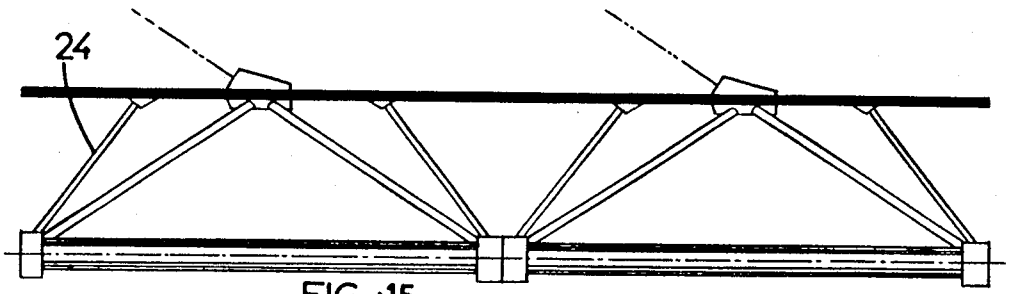
Figure 16:
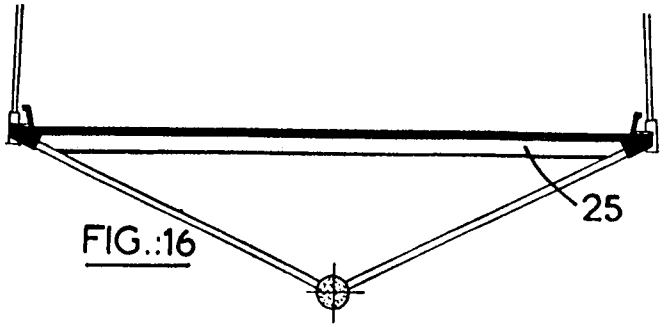
Figure 17:
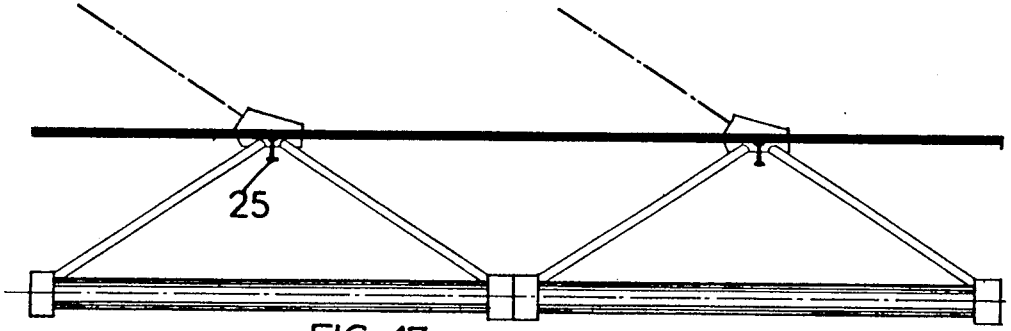

The upper node at the ends of the construction ensures the transmission of the forces from the oblique diagonals to the upper slab at the same time as the suspension on the guys. According to the embodiment of the invention illustrated in FIGS. 10, 11 and 12, in which there are respectively a cross-section, a longitudinal view and a horizontal view of the node, the essential assembly element is a gusset 15 made of bent sheet metal, the upper part of which merges with the suspension plane of the guys 2 and the lower part of which is arranged in the plane of the oblique diagonals 6. The guy is fastened to it by known means, such as fork joints 16 and an axle 17 or, according to the alternative version illustrated in FIG. 13, as a result of a duplication of the gusset making it possible to fasten the lower anchorage of the guy. The diagonals are easily connected to the gusset by welding along a slot made in the tube. To ensure that the forces are broken down according to the laws of statics, the bending edge 18 of the gusset is located in the mid-plane 19 of the roadway slab. The gusset also carries the anchorages 20, 21 of the reinforcements 22, 23 of the diagonal 6 and of the upper slab 4.

According to the invention, all the forces are therefore transmitted along a direct path, with the elimination of any welding or any assembly subject to breaking loose which is always a potential risk. In all the lower and upper nodes of the structure, the continuous gussets provided ensure an interpenetration of the chords and of the diagonals in order to ensure the abovementioned direct path of the forces.

In the general equilibrium of the construction and in the vicinity of the central part of the main span, high tensile forces occur, either as a result of the diffusion effect of the concentrated forces of the guys, or because of the exertion of overloads, in the following three elements of the lattice:

- the upper chord between the fastening points of the guys,
- the diagonals oriented in the extension of the guys,
- the lower chord between the junction nodes of the above diagonals.

These elements are represented by dashes in FIG. 1.

To ensure the equilibrium of the bridge under these tensile forces, according to the invention the following three groups of prestressing reinforcements are used:

- upper longitudinal reinforcements 23 anchored in the upper fastening gussets of the guys,
- oblique V-shaped reinforcements 22 placed inside the tensioned diagonals; the reinforcements are deflected in the lower part in the flange of the lower chord and in the upper part are anchored in the same assembly gusset as above,
- lower longitudinal reinforcements 9 outside the lower chord and described above.

The proposed arrangements ensure a direct transfer of all the loads and a complete continuity of all the forces of the guys, the two chords and the diagonals.

When the transverse dimensions of the bridge so require, it may be expedient to incorporate additional structural elements shown in FIGS. 14 to 17:

- intermediate poles 24 make it possible to reduce the bearing distances of the roadway and therefore its thickness, its weight and its reinforcements,
- transverse bridge pieces 25 which, for example, join the two gussets for connection to the edges, in order to divide the roadway slab into panels working both longitudinally and transversely.

Figure 18:
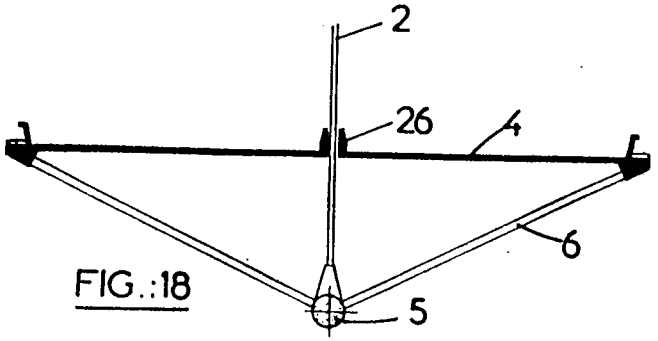
FIGS. 18 and 19 show two other particular embodiments of the invention, according to which a single guyed suspension is arranged at the center of the bridge.
Figure 19:
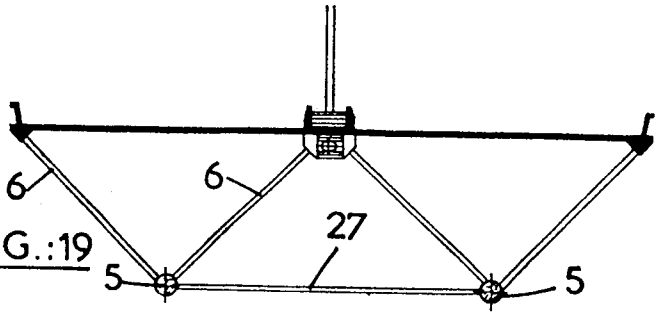

In some medium-span bridges (for example 200 to 400 m), it is possible to use only a single suspension plane, all the guys being arranged in the plane of symmetry of the bridge. FIGS. 18 and 19 give two possible arrangements, both forming part of the invention.

In the arrangement of FIG. 18, the guys 2 pass through the upper chord 4 via the guides 26 designed to damp the vibrations of the system and are anchored in the lower chord at the location of the nodes of the three-dimensional lattice which are formed by the junction of the diagonals with the lower chord.

In the arrangement of FIG. 19, there are two parallel lower chords 5 and two three-dimensional lattices, each composed of a lower chord, of half the upper chord 4 which is above this lower chord and of diagonals 6 connecting each lower chord to the upper-chord half corresponding to it. A crossbracing 27 connects the two lower chords 5 and stiffens the assembly as a whole, at the same time ensuring the continuity of the outer contour, and the cross-sectional stability and the torsional rigidity of the deck.

Figure 20:
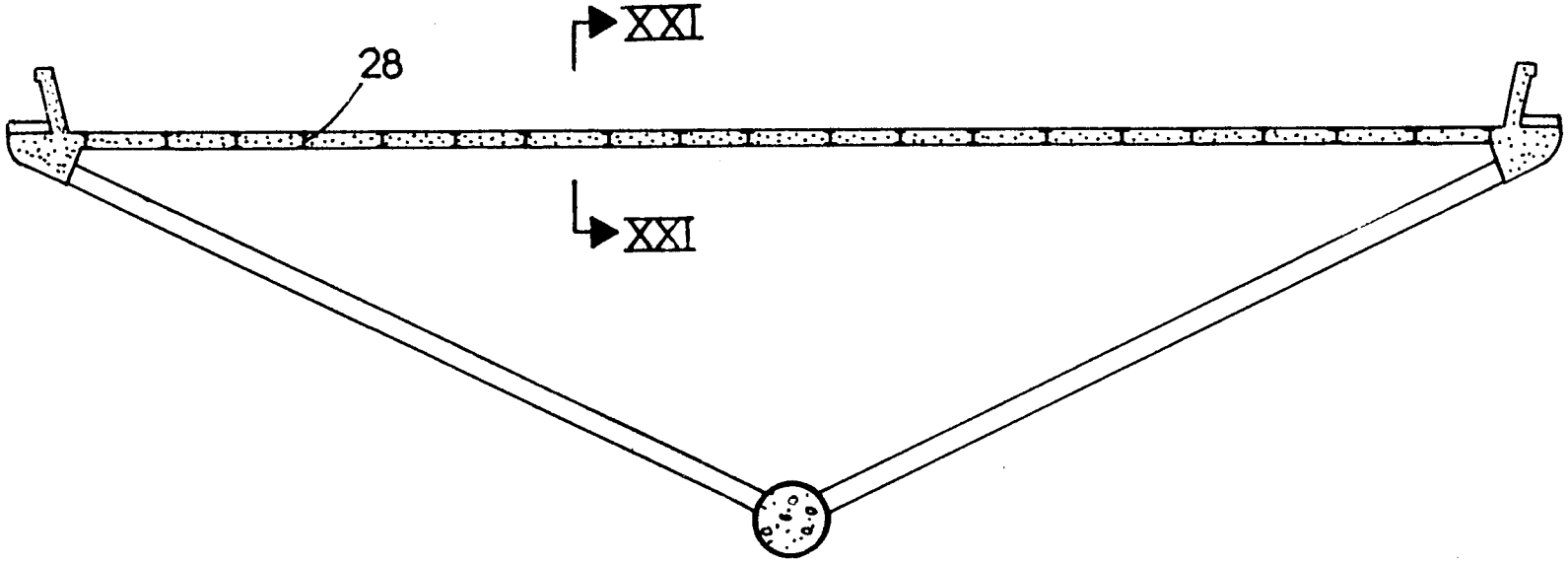
FIGS. 20 and 21 are respectively a part cross-section and a part longitudinal section illustrating an alternative method of producing the upper slab, according to which metal sections are embedded in the concrete slab, preferably in the longitudinal direction of the construction, in order to cooperate with the concrete in resisting the axial force in the deck, the concrete of the slab and the metal sections being fixed together as a result of a prestress at right angles to the direction of the sections.
Figure 21:
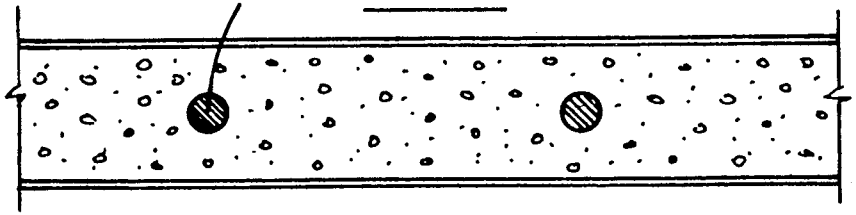

Finally, in constructions of very wide span (for example, 600 to 900 m), it is vital to reduce the weight of the deck as much as possible. To achieve this, the roadway slab is itself composed of a composite structure comprising continuous metal sections and concrete arranged between these, the materials being fixed together as result of a prestress at right angles to the direction of the sections. The confinement of the concrete of the slab by the metal sections makes it possible to reduce the minimum thickness of the slab to 0.10 m, without the risk of piercing under the concentrated loads of vehicles. FIGS. 20 and 21 show metal sections 28 arranged in the longitudinal direction and prestressing reinforcements 29 arranged transversely, these sections and reinforcements being arranged in the thickness of the roadway. It is clear that the sections and reinforcements can also be arranged differently.

The process according to the invention, designed essentially for producing wide-span guyed bridges, can extend to the production of non-guyed bridges. This arises when a large span to be made across a gap or over a navigation channel is framed by access viaducts which can advantageously be constructed according to the same processes as the main construction.

Figure 22:
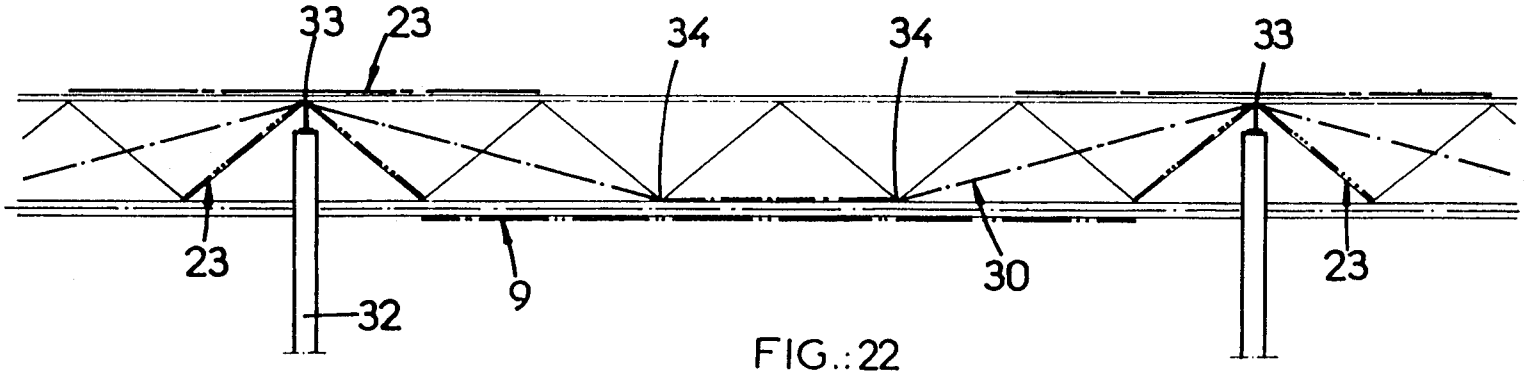
FIGS. 22 and 23 are respectively a longitudinal view and a cross-section showing the use of the invention to produce non-guyed spans, for example access spans located on either side of a guyed central span.
Figure 23:
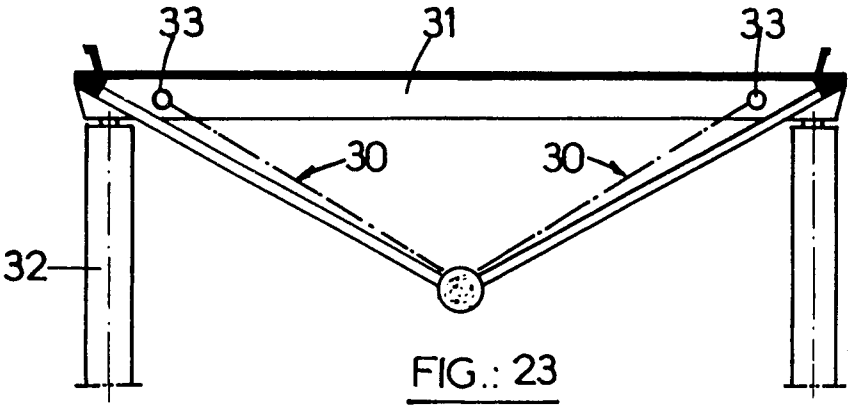

FIGS. 22 and 23 show the composition of a typical span in elevation and cross-section respectively.

Longitudinal bending resistance is imparted to the chords by prestressing reinforcements, such as 23, in the upper chord, and 9, in the lower chord, completed as required by outer prestressing reinforcements 30 of polygonal path and overlapping in line with the bearings formed by crossmembers 31 carried by piles 32 and adjacent to junctions of diagonals 6 with the upper chord 4. These outer prestressing reinforcements 30 connect points 33 located on the crossmembers 31 near their ends, that is to say near nodes of the three-dimensional lattice which are formed by the junction of the diagonals with the upper chord, passing via deflection points 34 which are other nodes of the three-dimensional lattice formed by the junction of the diagonals with the lower chord.

Resistance to shearing forces is completed by means of a prestressing of the diagonals, such as 22, in an embodiment identical to that described for a guyed structure.

In terms of construction, the devices of the invention make it possible to obtain a remarkably simple embodiment shown diagrammatically in FIGS. 24 to 27.

On the assumption that the deck is constructed up to the configuration illustrated in FIG. 24, the steps given below make it possible to carry out the following phase:

- the longitudinal advance of two temporary edging girders 35 located at the edge immediately below the upper assembly nodes. These girders have sufficient resistance to support, overhung, the dead weight of a new framework portion over the distance separating two successive guys. Each girder has a length a little greater than twice the above distance. At the center, the girder is immobilized by means of a centering stud 36 and suspension bars in line with the last guy fitted (FIG. 24). At the rear, the girder finds its bearing in line with the preceding guy. Known means are used to transport and put in place the new framework portion (upper chord, four diagonals and two upper gussets connected temporarily by means of a transverse beam ensuring the spacial rigidity of the element) which, in its final position, rests on the end of the two temporary longitudinal girders. The lower chord can be offered up and the flanges fixed together. The upper gussets are subsequently immobilized on the girders by means of studs (making it possible, at the same time, to adjust the longitudinal profile of the construction) and suspension bars, and a new guy is then put into place.

From then on, it is possible to pour the concrete of the upper slab, the weight of which is supported at the rear by the already constructed part of the deck and at the front by the new guy, the tension of which can be adjusted in order to provide the desired longitudinal profile of the construction.

Of course, the invention is not limited to the exemplary embodiments described above, and it is possible to make modifications to these without departing from the scope of the invention.

I claim:

1. A bridge composed of a deck and of means for supporting the deck, the deck comprising:

an upper chord forming a roadway slab having a horizontal mid-plane, a lower chord forming a continuous longitudinal element having a vertical longitudinal plane of symmetry in relation to said upper chord and a longitudinal axis of symmetry in said longitudinal plane, connecting girders, called "diagonals", connecting the upper and lower chords, having an axis, and directed obliquely both relative to the vertical and relative to the length of the bridge, and forming, with the chords, a three-dimensional lattice, wherein the axis at a first end of each of two adjacent diagonals converges on the longitudinal axis of symmetry of the lower chord, and the axis at a second end of each of two adjacent diagonals converges with the mid-plane of the upper chord, with the diagonals which are subjected to high tensile forces being prestressed by at least one continuous prestressing means which is connected to a first edge of the upper chord, bisects the longitudinal plane of symmetry of the lower chord and is connected to a second edge of the upper chord which is in the same plane as said first edge of the upper chord.

2. A bridge as claimed in claim 1, wherein said continuous prestressing means comprises prestressing reinforcements which are anchored at their two ends to the junction points of said diagonals with the upper chord and forms a V, the center of said V being at the junction point of said diagonals with the lower chord.

3. A bridge as claimed in claim 1, wherein the lower chord is formed from successive assembled portions and is equipped with longitudinal prestressing reinforcements which each put several assembled portions under compression.

4. A bridge as claimed in claim 3, further comprising means for prestressing the upper chord, comprising prestressing reinforcements connecting to one another the nodes of the three-dimensional lattice which are formed by the junction points of the diagonals with said upper chord.

5. A bridge as claimed in claim 1, wherein said means for supporting the deck comprise guys connecting supporting masts to nodes of the three-dimensional lattice which are formed by the junction points of the diagonals with the upper chord.

6. A bridge as claimed in claim 5, comprising at least two continuous lower chords and an equal number of three-dimensional lattices comprising diagonals, the axes of which converge on the axis of a lower chord, said chords being connected to one another by means of a crossbracing, these three-dimensional lattices each including part of the upper chord.

7. A bridge as claimed in claim 6, comprising two lower chords and two three-dimensional lattices, and wherein the means for supporting the deck comprise guys connecting the nodes of the three-dimensional lattices arranged in the axial plane of the bridge to supporting masts.

8. A bridge as claimed in claim 1, wherein the means for supporting the deck comprise guys connecting supporting masts to nodes of the three-dimensional lattice which are formed by the junction points of the diagram with the lower chord.

9. A bridge as claimed in claim 1, wherein the means for supporting the deck comprise transverse bearings on which the upper chord rests, and there are additional prestressing reinforcements which follow a polygonal path connecting two successive transverse bearings, passing via deflection points located on the lower chord.

10. A bridge as claimed in claim 9 wherein said additional prestressing reinforcements are not in the axial plane of the bridge and connect points which are located in the vicinity of nodes of said three-dimensional lattice.

11. A bridge as claimed in claim 1, wherein, to make the junction between the diagonals and the lower chord, there are gussets made of bent sheet metal, comprising two wings which are each in a longitudinal plane containing the axis of diagonals fastened on it, the gusset being fastened to the lower chord in such a way that the bending axis of the wings of the gusset coincides with the longitudinal axis of the lower chord.

12. A bridge as claimed in claim 11, wherein the lower chord is formed from successive assembled portions, and at least some of the gussets are fastened to the assembly points of successive portions.

13. A bridge as claimed in claim 1, wherein, to make the junction between the diagonals and the upper chord, there are gussets comprising a lower wing, arranged in a longitudinal plane containing the axis of the diagonals which are fastened on it, and an upper wing which is fastened to the upper chord in such a way that the bending axis of the wings of the gusset is in the mid-plane of the upper chord.

14. A bridge as claimed in claim 13, wherein the gusset has anchoring points for prestressing reinforcements of the diagonals and anchoring points for prestressing reinforcements of the upper chord.

15. A bridge as claimed in claim 13, wherein the connection between the gusset and the upper chord is a concrete/steel connection.

16. A bridge as claimed in claim 13, wherein the mid-plane of the upper wing of the gusset is in a longitudinal plane containing the axis of guys supporting the bridge, these guys being fastened to said gusset.

17. A bridge as claimed in claim 16, wherein the upper wing of said gusset is doubled into two parallel wings, between which the guy is fastened, the bending axis in this case being formed by the intersection of the mid-planes of the upper and lower wings.

18. A bridge as claimed in claim 1, wherein the upper chord forms a concrete slab reinforced by continuous metal sections and prestressing reinforcements arranged perpendicularly relative to these metal sections.

19. A process for constructing a bridge composed of a deck and of means for supporting this deck, the deck comprising:

an upper chord forming a roadway slab, a lower chord forming a continuous longitudinal element, connecting girders, called "diagonals", connecting the upper and lower chords and directed obliquely both relative to the vertical and relative to the length of the bridge, and forming, with the chords, a three-dimensional lattice, the axes of the diagonals converging on the longitudinal axis of the lower chord or the mid-plane of the upper chord, the diagonals which are subjected to high tensile forces being prestressed by means which are common to two concurrent diagonals, comprising the following steps:

placing, on a deck part already mounted, two longitudinal temporary edging girders on either side of the upper chord, so as to be overhung by a length at least equal to the longitudinal dimension of one mesh of the three-dimensional lattice, each girder being retained by means of two successive nodes of the three-dimensional lattice already mounted, bringing up a new mesh of the three-dimensional lattice, this mesh comprising at least one node located on the lower chord, two nodes located on the upper chord and the diagonals corresponding to these nodes, fixing together this new mesh and the deck part already mounted, the new mesh being supported by means of the temporary edging girders, starting the operations again by advancing the temporary edging girders along the mesh which has just been fixed.

20. A process as claimed in claim 19, wherein, during the fixing of the new mesh to the deck part already mounted, a suspension guy is also fastened to said new mesh.

21. A process as claimed in claim 19, wherein temporary edging girders are used, these being equipped with means, such as studs, for immobilizing them in the correct position in relation tot he meshes of the three-dimensional lattice already mounted.

* * * * *